US008779654B2

(12) United States Patent
Okazaki et al.

(10) Patent No.: US 8,779,654 B2
(45) Date of Patent: Jul. 15, 2014

(54) DISCHARGE LAMP APPARATUS INCLUDING A HIGH PRESSURE DISCHARGE LAMP, A CONCAVE REFLECTION MIRROR, AND A LASER LIGHT SOURCE

(75) Inventors: Ai Okazaki, Hyogo (JP); Yoshio Okazaki, Hyogo (JP); Takumi Sato, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/362,631

(22) Filed: Jan. 31, 2012

(65) Prior Publication Data

US 2012/0200216 A1 Aug. 9, 2012

(30) Foreign Application Priority Data

Feb. 8, 2011 (JP) ..... 2011-024524

(51) Int. Cl.
*H01J 5/16* (2006.01)

(52) U.S. Cl.
USPC ..... 313/113

(58) Field of Classification Search
USPC ..... 313/113
See application file for complete search history.

(56) References Cited

FOREIGN PATENT DOCUMENTS

JP 2004-029267 A 1/2004

*Primary Examiner* — Joseph L Williams
(74) *Attorney, Agent, or Firm* — Rader, Fishman & Grauer PLLC

(57) ABSTRACT

The present invention provides a discharge lamp apparatus including a high pressure discharge lamp, a concave reflection mirror, and a laser light source. An electrical discharge space is within the high pressure discharge lamp. A pair of electrodes faces each other in the electrical discharge space. A concave reflection mirror surrounds the high pressure discharge lamp. A laser light source emits laser light of a red wavelength band, wherein the laser light passes through the electrical discharge space.

5 Claims, 2 Drawing Sheets

DISCHARGE LAMP APPARATUS INCLUDING A HIGH PRESSURE DISCHARGE LAMP, A CONCAVE REFLECTION MIRROR, AND A LASER LIGHT SOURCE

CROSS-REFERENCES TO RELATED APPLICATION

This application claims priority from Japanese Patent Application Serial No. 2011-024524 filed Feb. 8, 2011, the contents of which are incorporated herein by reference in their entirety.

TECHNICAL FIELD

The present invention relates to a discharge lamp apparatus, and specifically, relates to a discharge lamp apparatus used as a light source of a projection type display apparatus such as a projector and a cinema projector.

BACKGROUND

A discharge lamp apparatus used as a light source of, for example, a projector and a cinema projector comprises a high pressure discharge lamp, which serves as a light emitting source, and a concave reflection mirror, which surrounds the high pressure discharge lamp. An optical system such as an integrator lens and a reflective mirror, and a spatial modulation element such as a DLP (Registered Trademark) and a liquid crystal panel are provided on a front side thereof in a light emitting direction of the concave reflection mirror, whereby light from the high pressure discharge lamp is emitted onto a screen to project an image on the screen.

In general, a light source, which has emission spectrum excellent in color balance of RGB, is required, to project an image, which is excellent color-reproduction nature on the screen. However since the light intensity of a red component is low in such a high pressure discharge lamp that is formed of an ultrahigh pressure mercury lamp while the light intensity of a green component is relatively high, it does not have the emission spectrum that is excellent in color balance of RGB as a whole, so that when the high pressure discharge lamp is used as a light source, there is a problem that the color-reproduction nature of the image projected on the screen is low.

To solve such a problem, in Japanese Patent Application Publication No. 2004-29267, a discharge lamp apparatus is proposed wherein a laser light source, which emits laser light of a red wavelength band, is provided separately from a high pressure discharge lamp, and the laser light is synthesized with light emitted from the high pressure discharge lamp. In the discharge lamp apparatus, the laser light source is arranged on a front side thereof in a light emitting direction of a concave reflection mirror, and the laser light is synthesized with the light emitted from the high pressure discharge lamp, on an optical path along the central axis (optical axis) of the concave reflection mirror, whereby the laser light, which is red light, is added to the light emitted from the high pressure discharge lamp, so that the light intensity of the red component may be compensated. Therefore, the light source, which has emission spectrum excellent in the color balance of RGB, can be obtained, and when such a light source is used as a light source of a projection type display apparatus, an image with an excellent color-reproduction nature may be projected.

However, since a degree of coherence of light emitted from such a laser light source is high compared with light emitted from such a high pressure discharge lamp, there is a phenomenon called "speckle noise," that is, a garish flickering on a screen occurs due to interference of the laser light, whereby the quality of an image deteriorates.

SUMMARY

The present invention relates to a discharge lamp apparatus, comprising a high pressure discharge lamp including a pair of electrodes facing each other in an electrical discharge space; a concave reflection mirror surrounding the high pressure discharge lamp; and a laser light source that emits laser light of a red wavelength band, wherein the laser light passes through the electrical discharge space.

Further, the laser light source may be arranged so that the laser light passes between the pair of electrodes in the high pressure discharge lamp. The laser light may be condensed by a condensing optical system between the pair of electrodes in the high pressure discharge lamp.

Furthermore, the laser light source may be arranged so that the laser light passes through the concave reflection mirror from a back side of a portion between the pair of electrodes in a light emitting direction of the concave reflection mirror and enters the electrical discharge space of the high pressure discharge lamp.

In addition, the discharge lamp apparatus may be used as a light source of a projector.

BRIEF DESCRIPTION OF THE DRAWINGS

Other features and advantages of the present discharge lamp apparatus will be apparent from the ensuing description, taken in conjunction with the accompanying drawings, in which.

DESCRIPTION

In the discharge lamp apparatus of the present invention, by using the high pressure discharge lamp and the laser light source, which emits laser light of a red wavelength band, together, it is possible to compensate the light intensity of a red component and, in addition, it is possible to obtain emission spectrum that is excellent in color balance of RGB. Moreover, since the laser light will pass through the container wall of the high pressure discharge lamp by arranging the laser light source so that laser light therefrom may pass through the electrical discharge space, a degree of the coherence of the laser light is reduced. Further, when the discharge lamp apparatus is used as a light source of a projection type display apparatus such as a projector and a cinema projector, a speckle noise can be reduced for a projected image with an excellent in color-reproduction nature. Detailed description of the present invention will be given below.

Figure 1:
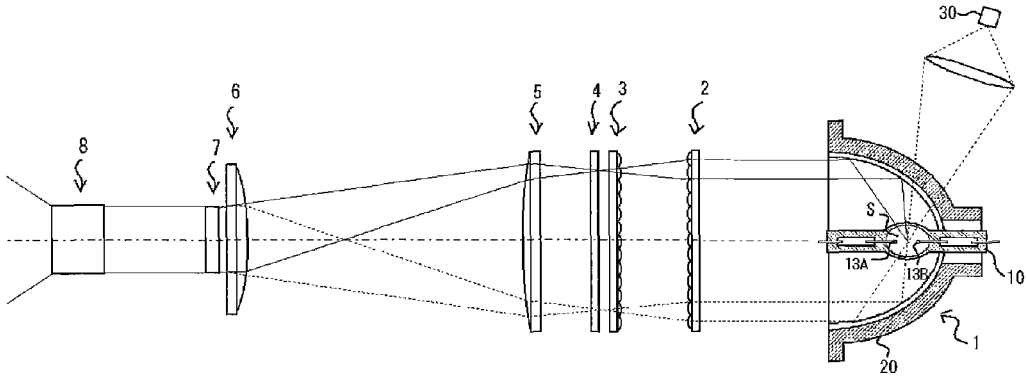
FIG. 1 is an explanatory cross sectional view of a schematic structure of an example of a projection type display apparatus equipped with a discharge lamp apparatus.
Figure 2:
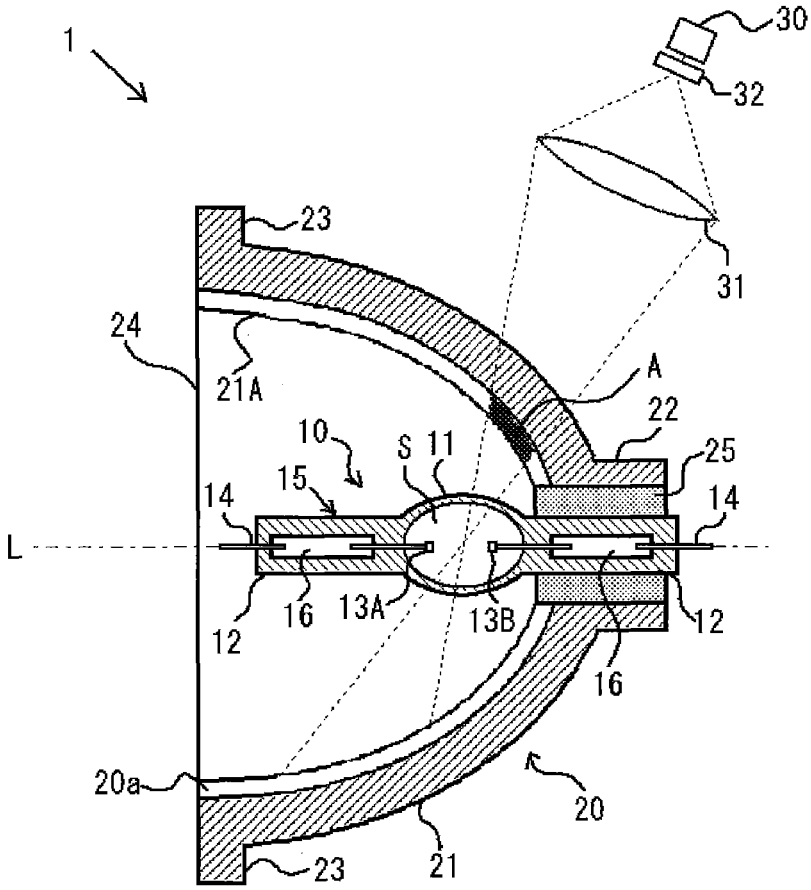
FIG. 2 is an explanatory cross sectional view of a schematic structure of an example of a discharge lamp apparatus.

FIG. 1 is an explanatory cross sectional view of a schematic structure of an example of a projection type display apparatus equipped with a discharge lamp apparatus. FIG. 2 is an explanatory cross sectional view of a schematic structure of an example of a discharge lamp apparatus. The projection type display apparatus, which uses a liquid crystal panel as a spatial modulation element, comprises a discharge lamp apparatus 1; a first integrator lens 2 and a second integrator lens 3 arranged to face each other to emit the light emitted from this discharge lamp apparatus 1 as light having uniform luminance; a polarization beam splitter 4 that splits the light from the second integrator lens according to polarization components; a spatial modulation element 7 made up of a liquid crystal panel, where the light emitted from the polarization beam splitter 4 enters through a first condensing lens 5 and a second condensing lens 6, thereby forming an image; and a projection lens 8, which amplifies and projects an image light modulated and formed in the spatial modulation element 7 on a screen (not shown).

The discharge lamp apparatus 1 according to this embodiment, comprises a high pressure discharge lamp 10 in which a pair of electrodes 13A and 13B is provided in an electrical discharge space S; a concave reflection mirror 20, which surrounds the high pressure discharge lamp 10; and a laser light source 30, which is arranged on a back side of a portion between the pair of electrodes 13A and 13B with respect to a light emitting direction of the concave reflection mirror 20 so that laser light may pass through the concave reflection mirror 20 and enters the electrical discharge space S.

A condensing optical system, which is made up of a diffusing lens 32 for diffusing the laser light emitted from the laser light source 30 and a condenser 31 for condensing the laser light diffused by the diffusing lens 32 at a point between the pair electrodes 13A and 13B of the high pressure discharge lamp 10, is provided between the laser light source 30 and the concave reflection mirror 20 of this discharge lamp apparatus 1.

The high pressure discharge lamp 10 is a short arc type ultra-high pressure mercury lamp, and comprises, for example, an oval sphere shape arc tube portion 11, which forms the electrical discharge space S, and an electric discharge container 15, which is made of, for example, quartz glass and which has rod shape sealing portions 12 continuously formed from both ends of the arc tube portion 11.

While the pair of electrodes 13A and 13B, which is made of, for example, tungsten, and which is arranged to face each other along an tube axis of the electric discharge container 15 is provided in an arc tube portion 11, rare gas and halogen gas in addition to mercury are also enclosed as light emitting material. The mercury is enclosed inside the arc tube portion 11 to obtain radiation light having required visible light wave length of, for example, 360-780 nm, and the amount thereof to be enclosed is 0.15 mg/mm$^3$ or more. The rare gas is enclosed inside the arc tube portion 11 to improve lighting start-up nature, and the enclosure pressure thereof is set to 5–50 kPa. Moreover, argon gas can be used suitably as the rare gas. Halogen gas enclosed inside the arc tube portion 11 causes a halogen cycle in the arc tube portion 11, whereby it is possible to prevent tungsten, which is structure material of the electrodes 13, from adhering to the inner wall of the electric discharge container 15, and the amount thereof to be enclosed is set to $2.0\times10^{-4}$–$7.0\times10^{-3}$ μmol/mm$^3$. Bromine can be used suitably as the halogen gas.

Each of the electrodes 13A and 13B is electrically connected to an external lead 14 through a metallic foil 16 is airtightly buried in the sealing portion 12.

A configuration example of the high pressure discharge lamp 10 is shown below. The maximum external diameter (maximum external diameter of the arc tube portion 11) of the electric discharge container 15 is 12.0 mm. A distance between the electrodes 13A and 13B is 1.2 mm. The internal volume of the arc tube portion 11 is 124 mm$^3$. The bulb wall loading is 3.5 W/mm$^2$. The rated voltage is 85 V and the rated power is 330 W.

The concave reflection mirror 20 is made of borosilicate glass, and is formed of concave base material including a reflective section 21, which has a paraboloidal reflective face 21A on an inner surface; a cylindrical neck portion 22, which is continuously formed from a back side thereof opposite to a light emitting direction of the reflective section 21 and which extends outward in a direction of an optical axis L of the concave reflection mirror 20; and a flange section 23, which is formed around an opening on a front side in the light emitting direction of the reflective section 21 and projects in a direction vertical to the direction of the optical axis L of the concave reflection mirror 20. While one of the sealing portions 12 of the high pressure discharge lamp 10 is inserted in the cylindrical neck portion 22 so that a tube axis of the electric discharge container 15 is in agreement with the optical axis L of the concave reflection mirror 20, the concave reflection mirror 20 is arranged so that a focal position of the concave reflection mirror 20 may be in agreement with an arc bright spot of the high pressure discharge lamp 10, specifically, between the pair of electrode 13A and 13B. The high pressure discharge lamp 10 is held and fixed by adhesive agent 25, which is filled up in a gap formed between an outer circumference face of the one of the sealing portions 12 and an inner circumference face of the neck portion 22.

A dielectric multilayer film 20*a*, which has a wave-length selection characteristic, is formed on the reflective face 21A of the reflective section 21. The dielectric multilayer 20*a* in this example, transmits infrared light while reflecting, for example, visible light, and is formed by laminating a silica ($SiO_2$) layer and a titania ($TiO_2$) layer by turns. The thickness of the dielectric multilayer 20*a* is 500 nm or more and 50 μm (micrometers) or less.

A film transmission section A is formed in the dielectric multilayer 20*a*, so that laser light which is emitted from the laser light source 30 may pass through it. This film transmission section A is configured so that the laser light, which is emitted from the laser light source 30, may pass through it, and other light may be reflected.

The laser light source 30 is arranged so that the laser light, which is emitted from the laser light source 30, may pass through the electrical discharge space S of the high pressure discharge lamp 10. Specifically, the laser light source 30 is arranged so that the laser light, which is emitted from the laser light source 30, may be condensed by the condenser 31 at the arc bright spot of the high pressure discharge lamp 10, i.e., between a pair electrodes 13A, and 13B. Moreover, the laser light source 30 is desirably arranged so that the laser light which is emitted from the laser light source 30 may pass through the concave reflection mirror 20 from a back side of a portion between the pair of electrodes 13A and 13B with respect to a light emitting direction of the concave reflection mirror 20, and enters the electrical discharge space S of the high pressure discharge lamp 10. Thus, in such an arrangement, a sacrifice area of the reflective face 21A of the concave reflection mirror 20, i.e., an area of the film transmission section A, can be made small, so that the radiation light of the high pressure discharge lamp 10 can be fully reflected.

The laser light source 30 is desirably configured to emit laser light of a red wavelength band and, for example, laser light of wavelength of 630-660 nm. In this example, the laser light source 30 is, a semiconductor laser whose peak wavelength of laser light is 639 nm and whose half bandwidth is 3 nm.

As long as the diffusing lens 32 diffuses the laser light, which is emitted from the laser light source 30, it is not specifically limited thereto and a convex lens, a concave lens, etc. can be used.

In this discharge lamp apparatus 1, the light emitted from the high pressure discharge lamp 10 is directly emitted or reflected by the reflector 21A of the reflective section 21 to be emitted, from a light emitting face 24 as approximately parallel light. The laser light, which is emitted from the laser light source 30 as diffused light, is condensed by the diffusing lens 32 and the condensing lens 31, so as to pass through the base wall of base material and the film transmission section A of the concave reflection mirror 20, through the container wall of the electric discharge container 15 of the high pressure discharge lamp 10, and then between the pair of electrodes 13A and 13B. Moreover, the laser light is reflected by the reflective face 21A of the reflective section 21 of the concave reflection mirror 20 and is synthesized with the radiation light of the high pressure discharge lamp 10, so as to be emitted from the light emitting face 24 as approximately parallel light.

Therefore, according to this discharge lamp apparatus 1, the light intensity of a red component can be compensated by using together the high pressure discharge lamp 10 and the laser light source 30 which emits the laser light of a red wavelength band, so that the emitted light may have emission spectrum, which is excellent in color balance of RGB. Further, since the laser light source 30 is arranged so that laser light may pass through the electrical discharge space S, the laser light passes through the container wall of the high pressure discharge lamp 10 and a phase difference arises in the laser light that reduces a degree of interference of the laser light. Thus, even when the discharge lamp apparatus is used as a light source of a projection type display apparatus such as a projector and a cinema projector, a speckle noise can be reduced while an image with an excellent color-reproduction nature is projected.

Figure 3:
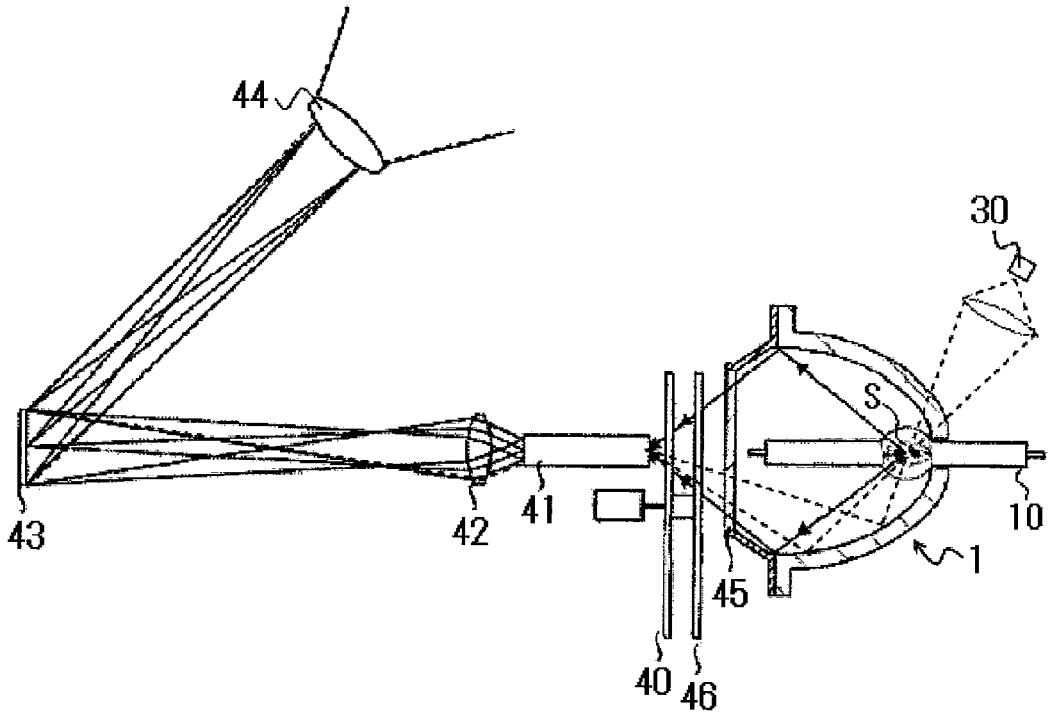
FIG. 3 is an explanatory cross sectional view of a schematic structure of another example of a projection type display apparatus equipped with a discharge lamp apparatus.

FIG. 3 is an explanatory cross sectional view of a schematic structure of another example of a projection type display apparatus equipped with a discharge lamp apparatus. Moreover, as shown in FIG. 3, the discharge lamp apparatus may also be installed in a projection type display apparatus using a DLP (Registered Trademark) as a spatial modulation element. This projection type display apparatus, comprises a discharge lamp apparatus 1; a color wheel 40, which light emitted from the discharge lamp apparatus 1 enters; a rod lens 41, which the light passing through the color wheel 40 enters; an integrator lens 42, which receives output light of the rod lens 41; a spatial modulation element 43 (DLP (Registered Trademark)), which receives the output light; and a projection lens 44, which projects the light emitted from the spatial modulation element 43 on a screen (not shown).

An opening of the discharge lamp apparatus 1 is closed by a glass member 45 on a front side in a light emitting direction of the concave reflection mirror 20. The glass member 45 has a function for blocking light such as ultraviolet radiation or infrared light, which is not desired to be emitted.

A filter 46, which transmits specific wavelength light, is provided between the glass member 45 of the discharge lamp apparatus 1 and the color wheel 40, and this filter 46 is rotated and driven together with the color wheel 40. RGB segments are formed in the color wheel 40, so that light colored in a time divided manner enters the rod lens 41.

According to such a projection type display apparatus, the discharge lamp apparatus 1, in which the light intensity of a red component is compensated, is used as a light source, so that a speckle noise can be reduced while an image with an excellent color-reproduction nature is projected.

Although the present invention is described as the above embodiments, the present invention is not limited thereto, and various alterations may be made. For example, the discharge lamp apparatus can be configured so as to have two or more laser light sources. Moreover, as long as the laser light source is arranged so that, for example, the laser light emitted from the laser light source may pass through the electrical discharge space of the high pressure discharge lamp, the laser light source may be arranged so that the laser light enters the electrical discharge space from the front side of a portion between the pair of electrodes in a light emitting direction of the concave reflection mirror. Further, for example, the reflective face of the concave reflection mirror may be ellipsoidal. Moreover, the base material, which forms the concave reflection mirror, may be made of metal such as aluminum, magnesium, copper and alloy thereof, and in this case, a cut-out part or a hole may be formed in part of the concave reflection mirror, so that the laser light, which is emitted from the laser light source, can pass through it.

An experimental example, in which the effects of the present invention were confirmed, will be described below.

Experimental Example 1

A projection state was confirmed by projecting radiation light from a high pressure discharge lamp (10) and laser light from a laser light source (30) on a screen, using the discharge lamp apparatus shown in FIG. 2. In addition, in this experimental example, for convenience, neither a liquid crystal panel and a DLP (Registered Trademark) nor various kinds of other optical components were used. A light blocking plate was arranged on a front opening section (a light emitting face 24) of the discharge lamp apparatus (1), and a small hole was formed at a condensing position of laser light in this plate, wherein only light, which passed through the small hole, was projected on the screen. In addition, a hole was formed in the concave reflection mirror (20), so that the laser light, which was emitted from the laser light source (30), entered it from a back side of a portion between a pair of electrodes (13A, 13B) in a light emitting direction of the concave reflection mirror (20). In procedure of the experiment, first, the high pressure discharge lamp (10) was not turned on, but only the laser light source (30) was turned on, and the projection state on the screen was observed. Next, the high pressure discharge lamp (10) was turned on while the laser light source (30) was turned on, and when the high pressure discharge lamp (1) was stabilized (after about five minutes passed), the projection state on the screen was observed again. In addition, in the experiment, an alternating current lighting type discharge lamp in which a distance between electrodes was 0.9 mm, and rated lighting electric power was 275 W, was used as the high pressure discharge lamp (10). Moreover, a He—Ne laser, in which oscillation wave was 632.8 nm and an output thereof was 15 mW, was used as the laser light source (30).

Experimental Example 2

The experimental example 2 was conducted in the same manner as that of the experimental example 1, expect that a hole was formed in the concave reflection mirror (20) so that laser light entered vertically between a pair of electrodes (13A, 13B).

Experimental Example 3

The experimental example 3 was conducted in the same manner as that of the experimental example 1, expect that a hole was formed in the concave reflection mirror (20) so that laser light entered from a front side of a portion between a pair of electrodes (13A, 13B) in a light emitting direction of the concave reflection mirror (20).

As a result of the experimental examples 1-3, in the case where laser light was projected on the screen by turning on only the laser light (30), it was visually confirmed that a speckle noise occurred. On the other hand, when the high pressure discharge lamp (10) was turned on combining therewith, the speckle noise was reduced to the extent that it could not be visually confirmed. The same result was confirmed in all cases without respect to incident directions of the laser light in the concave reflection mirror (20).

The preceding description has been presented only to illustrate and describe exemplary embodiments of the present discharge lamp apparatus. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope.

What is claimed is:

1. A discharge lamp apparatus, comprising:

a high pressure discharge lamp including a pair of electrodes facing each other in an electrical discharge space;

a concave reflection mirror surrounding the high pressure discharge lamp; and a laser light source that emits laser light of a red wavelength band, wherein the laser light passes through the electrical discharge space.

2. The discharge lamp apparatus according to claim 1, wherein the laser light passes between the pair of electrodes.

3. The discharge lamp apparatus according to claim 2, wherein the laser light is condensed by a condensing optical system between the pair of electrodes.

4. The discharge lamp apparatus according to claim 1, wherein the laser light passes through the concave reflection mirror from a back side of a portion between the pair of electrodes in a light emitting direction of the concave reflection mirror and enters the electrical discharge space of the high pressure discharge lamp.

5. The discharge lamp apparatus according to claim 1, wherein the discharge lamp apparatus is used as a light source of a projector.

* * * * *